US007823312B2

(12) United States Patent
Faifer

(10) Patent No.: US 7,823,312 B2
(45) Date of Patent: Nov. 2, 2010

(54) MAGAZINE WELL EXTENSION

(76) Inventor: Sagi Faifer, 43 Yaacov Olamy St, Mishmar Hashiva (IL) 50297

( * ) Notice: Subject to any disclaimer, the term of this patent is extended or adjusted under 35 U.S.C. 154(b) by 0 days.

(21) Appl. No.: 12/642,889

(22) Filed: Dec. 21, 2009

(65) Prior Publication Data

US 2010/0154275 A1 Jun. 24, 2010

Related U.S. Application Data

(60) Provisional application No. 61/139,604, filed on Dec. 21, 2008.

(51) Int. Cl.
*F41A 9/61* (2006.01)

(52) U.S. Cl. ..... 42/49.02; 42/71.01

(58) Field of Classification Search ..... 42/6, 42/7, 49.01, 49.02, 71.01, 71.02, 72, 73, 42/75.03, 90, 94
See application file for complete search history.

(56) References Cited

U.S. PATENT DOCUMENTS

| | | | | |
|---|---|---|---|---|
| 4,484,404 | A * | 11/1984 | Johnson | 42/90 |
| 4,528,765 | A * | 7/1985 | Johnson | 42/70.11 |
| 4,709,496 | A * | 12/1987 | Johnson | 42/70.11 |
| 5,253,442 | A * | 10/1993 | Kim | 42/50 |
| 5,279,059 | A * | 1/1994 | Howard | 42/90 |
| 5,452,534 | A | 9/1995 | Lambie | |
| 5,806,224 | A | 9/1998 | Hager | |
| 5,900,577 | A * | 5/1999 | Robinson et al. | 89/191.01 |
| 6,557,287 | B2 * | 5/2003 | Wollmann | 42/50 |
| D487,791 | S * | 3/2004 | Freed | D22/108 |
| 7,117,622 | B2 * | 10/2006 | Freed et al. | 42/7 |
| D576,701 | S | 9/2008 | Nichols | |
| 7,637,048 | B2 * | 12/2009 | Tal et al. | 42/87 |
| 2008/0163531 | A1 * | 7/2008 | Zukowski et al. | 42/21 |
| 2009/0313873 | A1 * | 12/2009 | Roth | 42/72 |
| 2010/0132238 | A1 * | 6/2010 | Werner et al. | 42/71.02 |

OTHER PUBLICATIONS http://www.airsoftpost.com/product_info.php?products_id=25513, Jan. 1, 2008.*
http://www.airsoftglobal.com/product_info.php?cPath=446_450&products_id=3960, May 10, 2006.*
M4 M16 Magwell Black http://www.ebairsoft.com/magwell-black-p-847.html?reviews_id=2138.
Office Action mailed Jun. 21, 2010; U.S. Appl. No. 12/711,274, filed Feb. 24, 2010, pp. 1-12.
Applicant Summary of Interview with Examiner filed on Jul. 21, 2010; U.S. Appl. No. 12/711,274, filed Feb. 24, 2010.

* cited by examiner

*Primary Examiner*—Michael Carone
*Assistant Examiner*—Michael D David
(74) *Attorney, Agent, or Firm*—Law Office of Arthur M. Antonelli, PLLC

(57) ABSTRACT

A magazine well extension for a firearm having a magazine well in a lower receiver, the magazine well extension including a substantially hollow body including a magazine well extension portion, for covering and extending beyond an opening of the magazine well of the firearm, the magazine well extension portion being adapted and configured to guide a magazine into the magazine well of the firearm and coupling elements for coupling the body about the lower receiver of the firearm. The inner surface of the body is contoured to conform to the outer surface of the lower receiver, and the body is shaped as a grip, for use as a fore grip on the firearm.

20 Claims, 8 Drawing Sheets

MAGAZINE WELL EXTENSION

RELATED APPLICATIONS

This application claims the benefit of U.S. Provisional Application No. 61/139,604, filed Dec. 21, 2008, the entire disclosure of which is incorporated herein by reference.

FIELD OF THE INVENTION

The present invention relates to magazine holders, in general, and in particular, to a magazine well extension for firearms, such as M-16 submachine guns, rifles, and the like.

BACKGROUND OF THE INVENTION

Many guns and firearms use ammunition provided in preloaded magazines, and accordingly are configured with integrated or built-in magazine holders. A magazine holder is a well or hollow compartment in the lower receiver of the frame where the firearm is gripped by the operator. The well has a bottom opening, and an interior sized and shaped to snugly hold a magazine. When the ammunition in the magazine has been discharged, the operator removes the empty magazine and inserts a freshly loaded magazine into the well through the bottom opening.

Firearm magazine well openings are usually just slightly larger than the cross-section of the magazines the firearms are designed to receive. As a result, in practice the magazines need to be carefully aligned with the well openings before insertion. This requires a degree of attention and time on the part of the operator. In firearm applications involving law enforcement or the military, any extra time spent replacing magazines may expose the operator to danger. In other applications such as sport shooting, the extra time may be inconvenient and counterproductive.

Various attempts have been made to improve magazine wells, to make it easier and quicker to insert a fresh magazine. One approach is to alter the magazine well opening by attaching an extension or add-on to the firearm frame. The frame or magazine well extensions generally include an opening larger than the magazine well opening, and provide a beveled edge around the opening to help guide a magazine into the holder. In some cases, particularly in pistols, they also increase the length of the magazine well by providing a frame extension that is bolted to the main spring housing of the pistol.

Some machining of the gun frame is usually required in order to attach the magazine well extension. For example, bores may need to be drilled in the gun frame so that the extension can be attached by screws. Other extensions may be attached by welding. As a result, the services of a skilled person such as a gunsmith, machinist, or welder are usually required, which necessarily increases the cost and complication of the extension.

SUMMARY OF THE INVENTION

The present invention relates to a magazine well extension for a firearm having a magazine well in a lower receiver, the magazine well extension being adapted and configured to guide a magazine into the magazine well of the firearm and being shaped as a fore grip.

There is provided according to the invention, a magazine well extension for a firearm having a magazine well in a lower receiver, the magazine well extension including a substantially hollow body including a magazine well extension portion, for covering and extending beyond an opening of the magazine well of the firearm, the magazine well extension portion being adapted and configured to guide a magazine into the magazine well of the firearm and coupling elements for coupling the body about the lower receiver of the firearm. The inner surface of the body is contoured to conform to the outer surface of the lower receiver, and the body is shaped as a grip, for use as a fore grip on the firearm.

According to a preferred embodiment, the body includes two substantially hollow shell portions couplable to one another about the lower receiver, each shell portion defining an external, ergonomic grip portion defining a plurality of grooves for receiving a shooter's fingers.

There is also provided, according to the invention, a method for forming a magazine well extension for a firearm having a magazine well in a lower receiver, the method including providing a substantially hollow body for coupling about a lower receiver of the firearm, defining a magazine well extension portion on the body, for covering and extending beyond an opening of a magazine well of the firearm, the magazine well extension portion being adapted and configured to guide a magazine into the magazine well of the firearm, and shaping the body as a grip, for use as a fore grip on the firearm.

BRIEF DESCRIPTION OF THE DRAWINGS

The present invention will be further understood and appreciated from the following detailed description taken in conjunction with the drawings in which.

DETAILED DESCRIPTION OF THE INVENTION

The present invention relates to magazine well extensions which are adapted for mounting on a firearm, preferably by coupling about the receiver. The magazine well extension is shaped like a pistol grip so it can also be used as a fore grip. The magazine well extension is particularly suited for use with firearms having a magazine well in a lower receiver.

Figure 1:
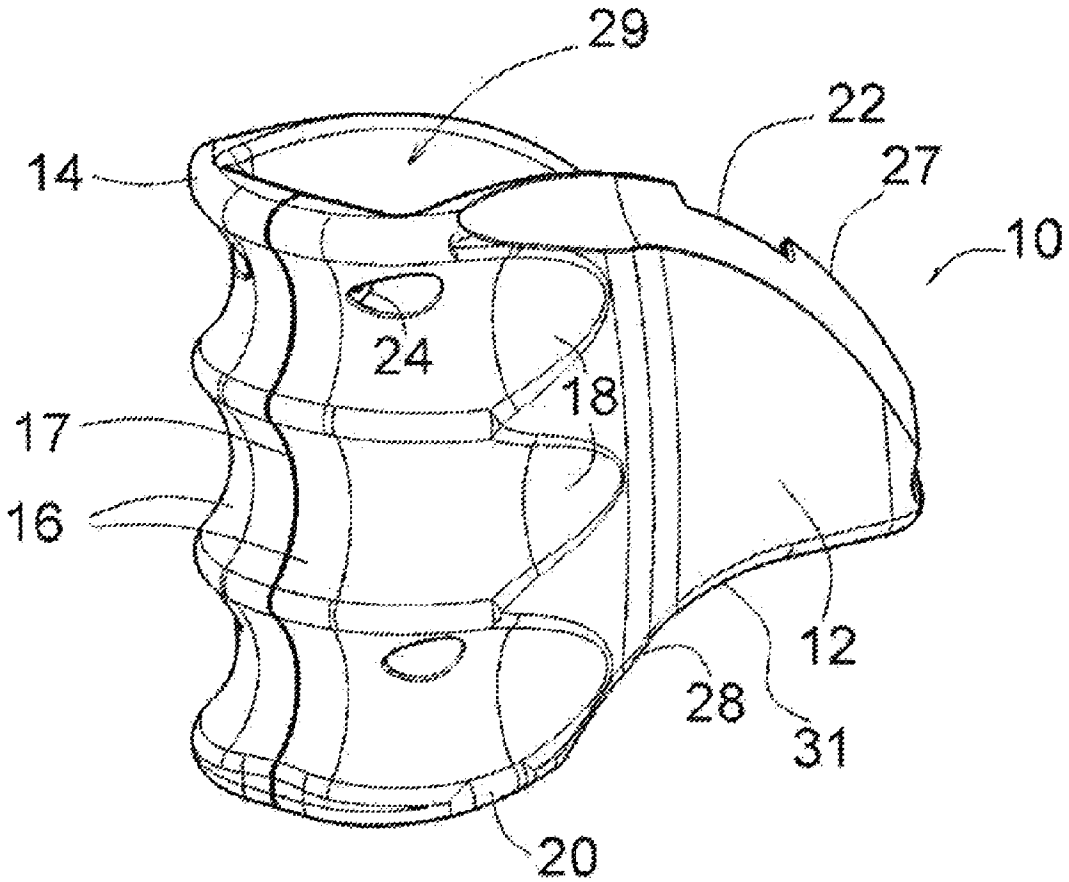
FIG. 1 is a side isometric view of a magazine well extension constructed and operative in accordance with a preferred embodiment of the present invention.

Referring now to FIG. 1, there is shown an isometric view of a magazine well extension 10, constructed and operative in accordance with one embodiment of the invention. Further views may be seen in FIGS. 2, 3, 4, and 5, which respectively show front, bottom, side, and interior views of this embodiment. Magazine well extension 10 enables an operator of a firearm to easily and quickly insert a magazine into the magazine well, and to make use of the extension as a fore grip.

Figure 2:
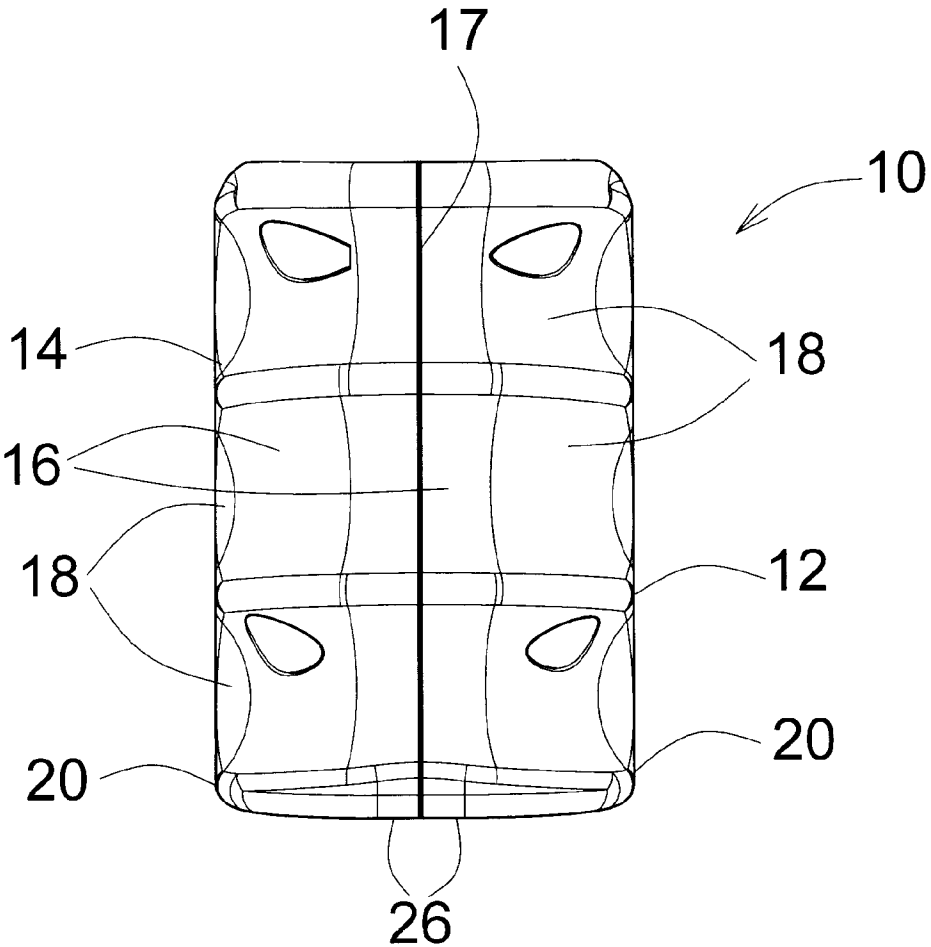
FIG. 2 is a front view of the magazine well extension of FIG. 1.
Figure 3:
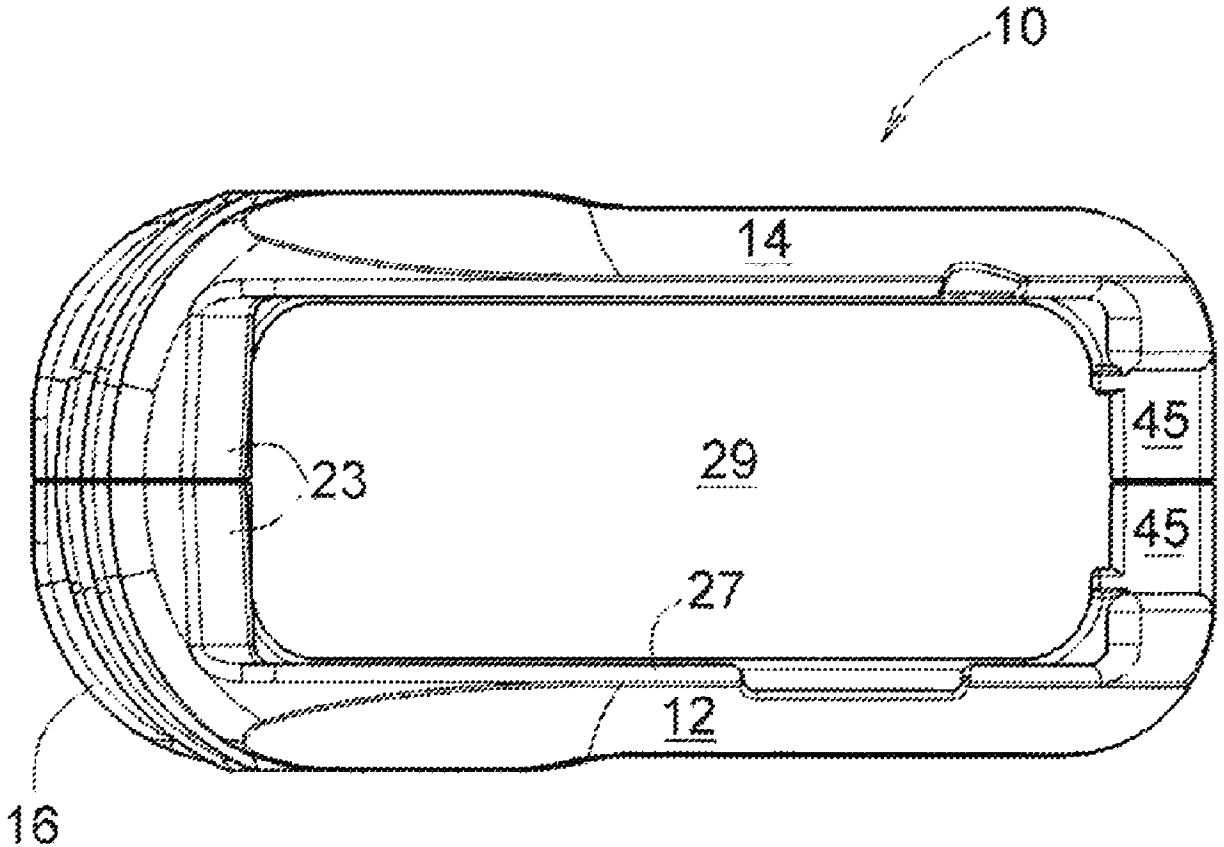
FIG. 3 is a top view of the magazine well extension of FIG. 1.

As shown in detail in FIGS. 1-3, magazine well extension 10 includes a substantially hollow body composed of two shell portions or opposing sides 12 and 14. Shell portions 12, 14 are substantially hollow, and are sized and shaped to couple or attach to one another to form magazine well extension 10. More particularly, the front and rear walls of shell portions 12 and 14 have complementary inner edges that fit together to form magazine well extension 10, and that preferably form a smooth outer surface at their points of contact. FIGS. 1 and 2 show a joining line 17 where shell portions 12 and 14 meet.

Figure 4:
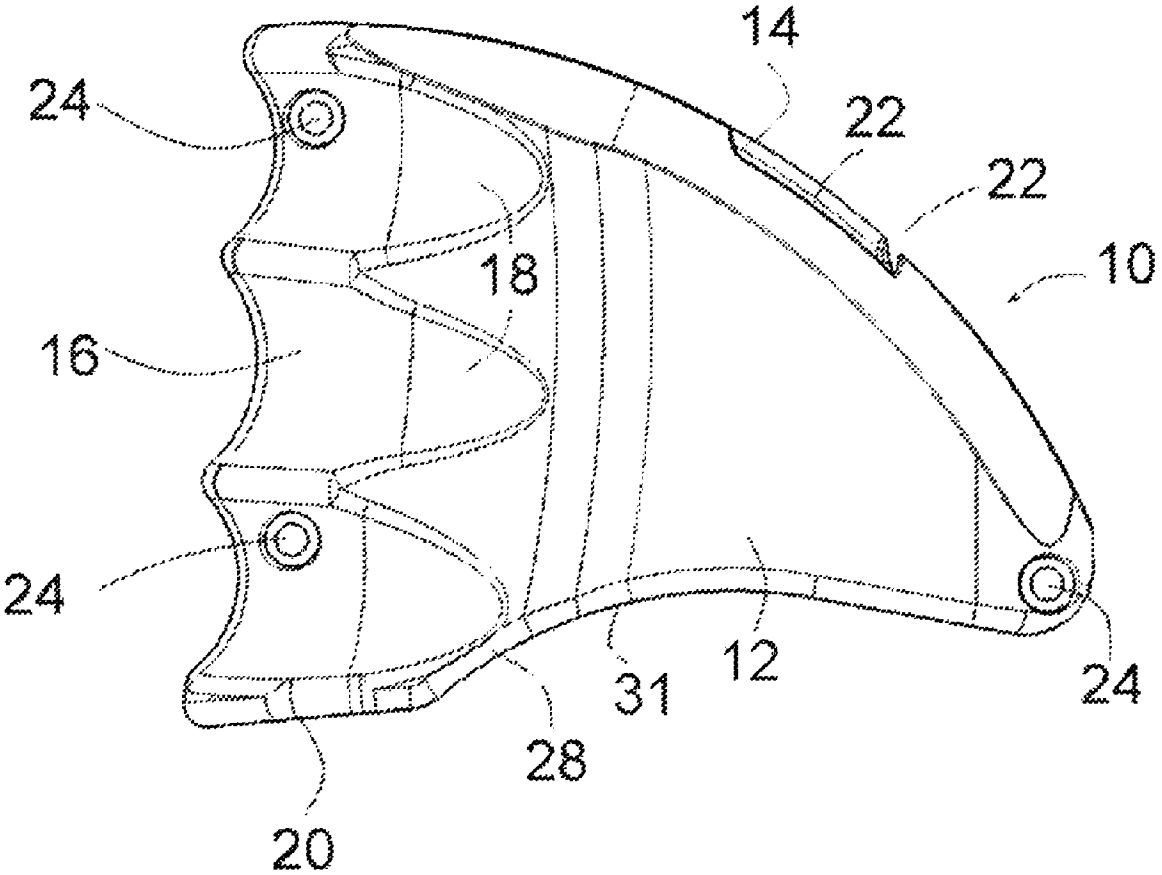
FIG. 4 is a side view of the magazine well extension of FIG. 1.

Referring to FIG. 4, the shell portions 12 and 14 define a magazine well extension portion 20, here illustrated as a depending skirt, which includes a well extension opening 28 and a hollow interior 29 to enclose the magazine well of the firearm. The magazine well extension portion 20 preferably also includes sloping or rounded beveled edges 26 positioned around the perimeter of well extension opening 28. A firearm magazine is inserted through well extension opening 28, which acts as a guide or funnel to smoothly guide the magazine into the magazine well. It will be appreciated that these features enhance the ease and speed with which a magazine may be inserted into the magazine well. The greater width of well extension opening 28 provides a larger target area for the magazine being inserted, and rounded beveled edges 26 provide a smoother transition into the magazine well, so that less precision in placement is required of the operator.

Each shell portion 12, 14 further defines an external, ergonomic grip portion 16 defining a plurality of grooves or channels 18 for receiving the fingers of a shooter. It may be appreciated that magazine well extension 10 is shaped like a pistol grip so it can also be used as a fore grip.

Shell portions 12 and 14 further include coupling elements 24 to connect the two portions 12 and 14 together, and for affixing magazine well extension 10 about a lower receiver of a firearm and about its magazine well. It is a particular feature of the invention that no modification or gunsmithing is required on a firearm in order to securely mount magazine well extension 10 thereon. The shell portions can be affixed about a lower receiver of a firearm in any desired fashion. In the embodiment shown in the figures, and particularly in the side view of FIG. 4, the shell portions are illustrated as being releasably coupled or affixed to one another by means of three bolts. A recess 22 may be provided in the upper wall of each shell portion 12 and 14, to accommodate protruding portions of the receiver.

Figure 5:
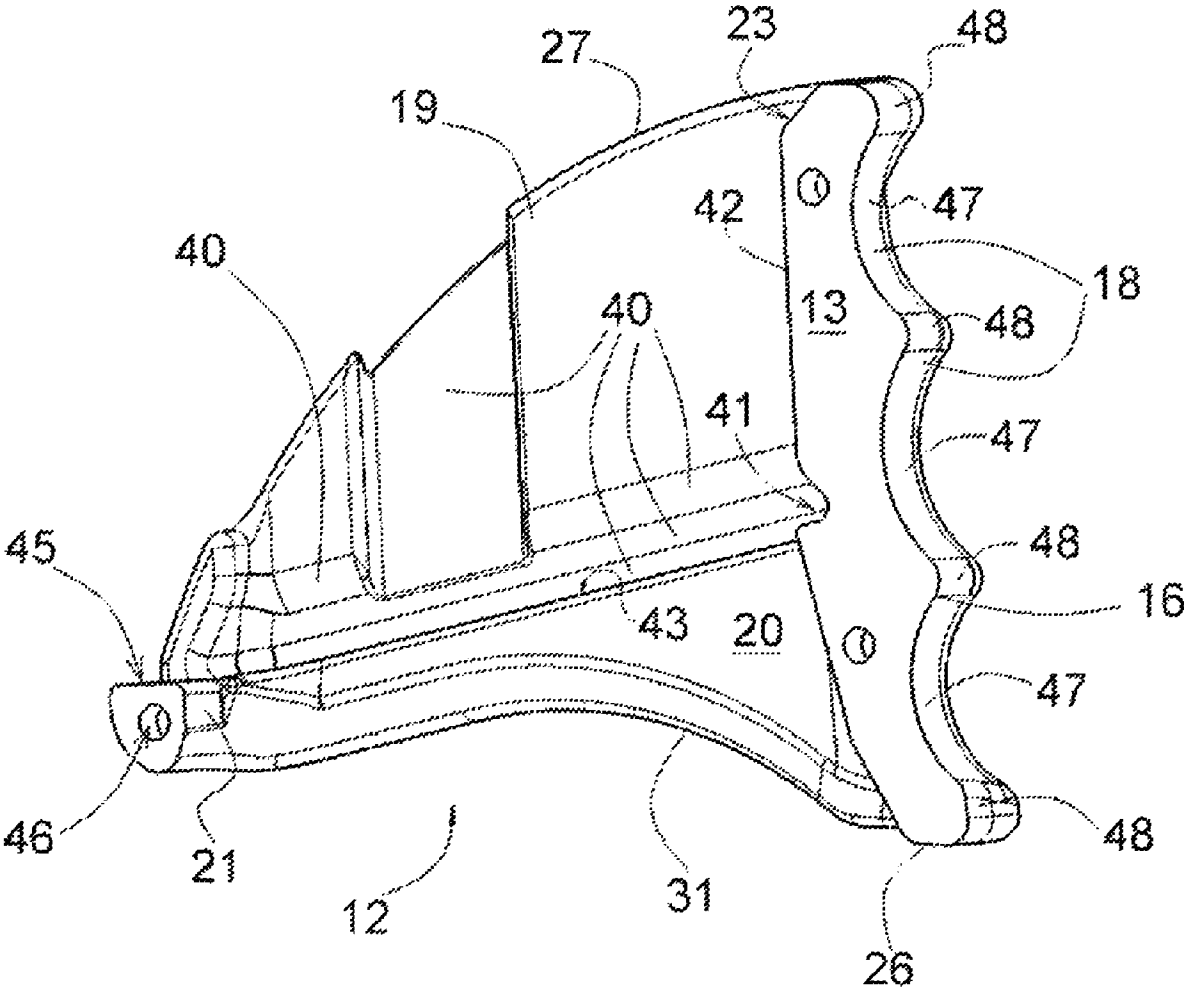
FIG. 5 is a side isometric view of the interior of the magazine well extension of FIG. 1.

FIG. 5 is a side isometric view of the interior of a representative shell portion, in this case shell portion 14. As illustrated, the shell portion interior is sized and shaped to match or conform to the corresponding external surface of the lower receiver of a firearm about which the shell portion attaches. More particularly, the shell portion has several surfaces 40 that together assist magazine well extension 10 to engage and hold the lower receiver. Thus, surfaces 40 are contoured to be complementary to the outer contour of the lower receiver. It will be appreciated that any of surfaces 40 may be horizontal, vertical, or aligned along a diagonal of any slope, as appropriate, to form a close fit with the external surface of the lower receiver. According to a preferred embodiment of the invention, magazine well extension 10 is formed of reinforced polymer. Other materials that are lightweight, strong, and relatively easy to manufacture or form into the desired shape, such as aluminum, steel, or plastic composites other than reinforced polymer, are also comprehended by the present invention.

Figure 6:
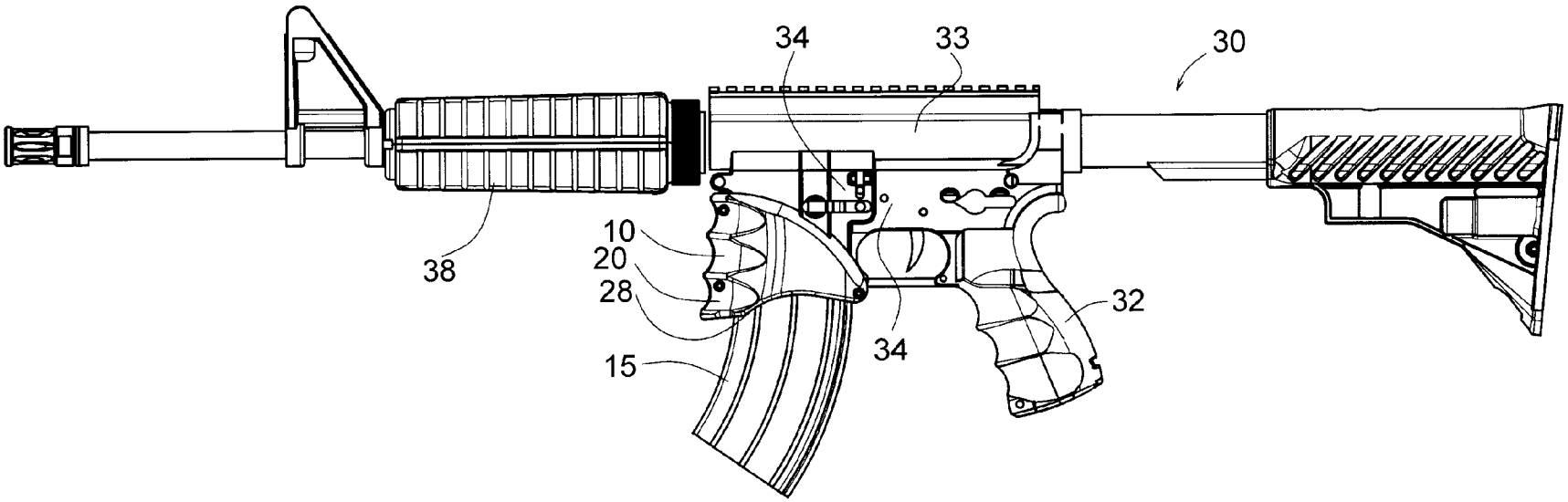
FIG. 6 is a side view of the magazine well extension of FIG. 1 mounted on an M-16 rifle, by way of example only.
Figure 7:
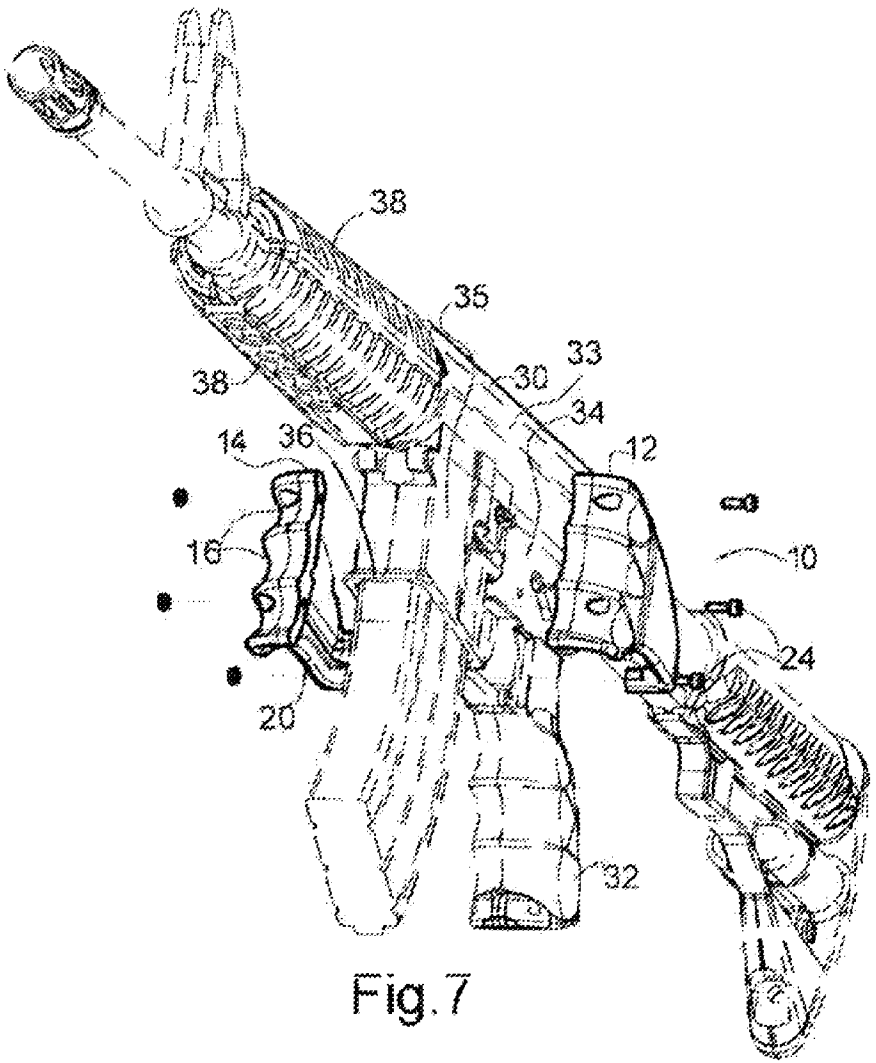
FIG. 7 is a front isometric view exploded illustration of the magazine well extension of FIG. 6.

Referring to FIG. 5, the magazine well extension includes a shell portion 12 (or receptacle part) having a front wall 13, a side wall 19, and a strut 21. As shown in this embodiment, the exterior surface of the front wall 13 includes three saddles 47, and each saddle 47 connects two peaks 48. Additionally, the interior surface of the front wall 13 in this embodiment includes a convex segment 23 located adjacent to the top surface of the front wall. The interior surface of the front wall in this embodiment also includes a front groove 41 and a planar surface 42, which extends from the convex segment 23 to the front groove 41. Referring to FIGS. 6 and 7, the convex segment 23 fits against a curved portion of the lower receiver adjacent to the front pivot.

Referring to FIG. 5, the side wall 19 in this embodiment includes an upper contour 27 which is convex in shape and a lower contour 31 which is concave in shape. The side wall 19 in this embodiment further includes a side groove 43. The representative shell portion 12 (or receptacle part) shown in FIG. 5 also includes a strut 21 disposed opposite the first wall and adjacent to the side wall. In this embodiment the strut 21 has a planar upper surface 45 and a bore 46 for receiving a coupling element, for example, a bolt as depicted in FIG. 7.

An overview of the invention in use may be seen in FIG. 6, which shows magazine well extension 10 installed on a firearm 30 which uses ammunition provided in a removable magazine 15. In this figure, firearm 30 is shown as an M-16, by way of example only. Firearm 30 includes a grip 32, a handguard 38, a body including an upper receiver 33, a lower receiver 34, and a hollow magazine well 36 in lower receiver 34 (shown in FIG. 8).

Figure 8:
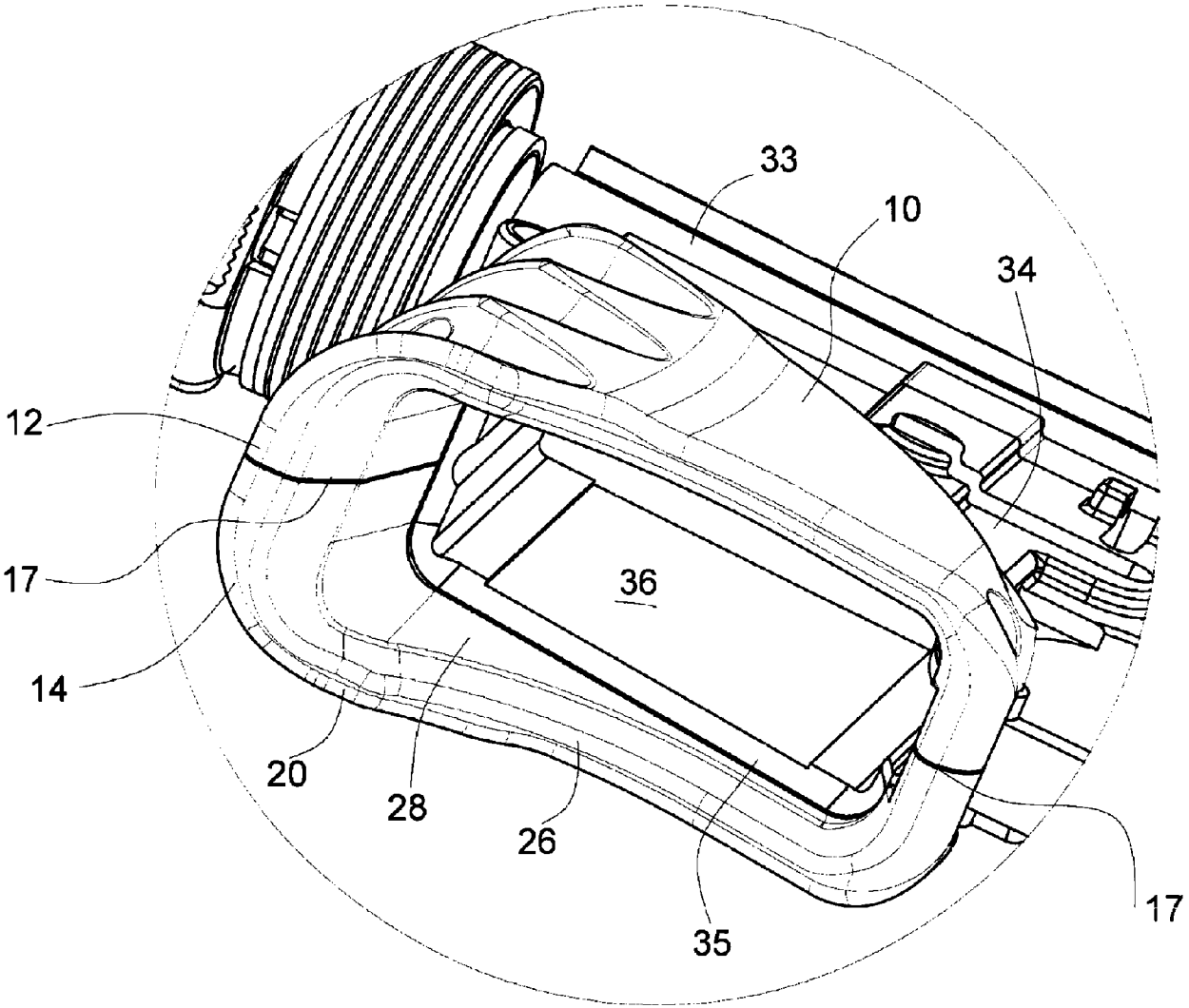
FIG. 8 is a bottom perspective view of the magazine well extension of FIG. 6, with the magazine removed.

FIGS. 7 and 8 are exploded and bottom perspective illustrations, respectively, of magazine well extension 10 mounted on firearm 30, shown in FIG. 6. The two shell portions 12 and 14 of magazine well extension 10 of the present invention are adapted to be affixed about lower receiver 34 and magazine well 36, behind handguard 38. As noted above, each shell portion in the illustrated embodiment is affixed about lower receiver 34 by coupling elements 24, here illustrated as three bolts. Recess 22 permits the shell portions to be firmly seated on lower receiver 34, without interference from any protruding portions of the upper or lower receiver that may be present. As best seen in FIG. 8, the depending skirt of the extension portion 20 covers and extends beyond the opening 35 of magazine well 36. Also as noted, depending skirt 20 preferably has rounded or sloping edges 26 to guide and make it easier and more comfortable for the operator to insert magazine 15 into magazine well 36.

The embodiment of magazine well extension 10 shown in the figures is particularly suited for use with firearms such as the M-16, AR-15, and M4. It may be appreciated that the present invention also comprehends adapting the shape and configuration of the shell portions so that magazine well extension 10, in other embodiments, may be similarly used with other firearms having a magazine well in a lower receiver.

While the invention has been described with respect to a limited number of embodiments, it will be appreciated that many variations, modifications and other applications of the invention may be made. It will further be appreciated that the invention is not limited to what has been described hereinabove merely by way of example. Rather, the invention is limited solely by the claims which follow.

The invention claimed is:

1. A magazine well extension for a lower receiver of a rifle having a front pivot, a changing contour adjacent the front pivot, a trigger guard and a magazine well, the magazine well extension comprising:

a first receptacle part having a distal end and a proximal end which comprises a first wall disposed at the distal end which comprises a top surface, a bottom surface, a first exterior surface, a first interior surface which extends from the top surface to the bottom surface, and which comprises
a convex segment adjacent the top surface,
a front groove disposed below the convex segment, and
a magazine guide disposed below the front groove,
the convex segment being configured and dimensioned to conform to a changing contour adjacent the front pivot of a lower receiver;

a second wall, adjacent the first wall, which comprises
an upper contour,
a lower contour which comprises a concave segment positioned above the bottom surface of the first wall,
a second exterior surface,
a second interior surface which extends from the upper contour to the lower contour, and which comprises a side groove; and a strut, disposed opposite the first wall and adjacent to the second wall, which comprises
a first end surface, and
an upper surface adjacent the first end surface;
the front groove, side groove and upper surface being aligned and connected to receive a magazine well and a trigger guard of a lower receiver; and a second receptacle part which comprises
a fourth wall connected to the first wall, and
a fifth wall, disposed opposite the second wall and adjacent to the fourth wall, the second receptacle part being joined to the first receptacle part such that the first and second receptacle parts are configured and dimensioned to lock onto a magazine well and a trigger guard of a lower receiver of a rifle and to guide loading of the magazine well.

2. The magazine well extension of claim 1, wherein the first receptacle part further comprises a front grip face, and first exterior surface defines the front grip face.

3. The magazine well extension of claim 2, wherein the front grip face further comprises a saddle connecting two peaks.

4. The magazine well extension of claim 2, wherein the second exterior surface further comprises a side grip face.

5. The magazine well extension of claim 1, further comprising a bore extending into the first end surface.

6. The magazine well extension of claim 1, wherein the top surface is convex.

7. The magazine well extension of claim 1, wherein the concave segment abuts the proximal end.

8. A method of transforming a magazine well of a rifle lower receiver into a fore grip comprising:

providing a magazine well extension of claim 1;

positioning a lower receiver of a rifle into the first receptacle part;

interlocking the lower receiver in the first and second receptacle parts; and fixing the first receptacle part to the second receptacle part.

9. A magazine well extension for a lower receiver of a rifle having a front pivot, a contour adjacent the front pivot, a trigger guard and a magazine well, the magazine well extension comprising:

a first receptacle part having a distal end and a proximal end which comprises
a first wall disposed at the distal end which comprises
a top surface,
a bottom surface,
a first exterior surface,
a first interior surface which extends from the top surface to the bottom surface, and which comprises
a front groove, and
a magazine guide disposed below the front groove;

a second wall, adjacent to the first wall, which comprises
an upper contour,
a lower contour which comprises a concave segment positioned above the bottom surface of the first wall,
a second exterior surface, and
a second interior surface which extends from the upper contour to the lower contour, and which comprises a side groove.

10. The magazine well extension of claim 9, wherein the first interior surface further comprises a first segment adjacent the top surface, the first segment being configured and dimensioned to conform to a contour adjacent the front pivot of a lower receiver.

11. The magazine well extension of claim 10, wherein the first segment is convex.

12. The magazine well extension of claim 10, wherein the first interior surface further comprises a planar segment extending from the first segment to the front groove.

13. The magazine well extension of claim 9, wherein the concave segment extends to the proximal end.

14. The magazine well extension of claim 9, further comprising a second receptacle part which comprises
a fourth wall connected to the first wall, and
a fifth wall, disposed opposite the second wall and adjacent to the fourth wall, the second receptacle part being joined to the first receptacle part such that the first and second receptacle parts are configured and dimensioned to lock onto a magazine well and a trigger guard of a lower receiver of a rifle and to guide loading of the magazine well.

15. The magazine well extension of claim 14, further comprising a coupling element for fixing the first receptacle part to the second receptacle part.

16. The magazine well extension of claim 14, wherein the first receptacle part further comprises a strut, disposed opposite the first wall and adjacent to the second wall, which comprises a first end surface, and
an upper surface adjacent the first surface,
the front groove, side groove and upper surface being aligned and connected to receive a magazine well and a trigger guard of a lower receiver.

17. The magazine well extension of claim 16, further comprising a bore extending from the first end surface to the second exterior surface.

18. The magazine well extension of claim 9, wherein the first exterior surface defines a front grip face.

19. The magazine well extension of claim 18, wherein the first exterior surface extends from the top surface to the bottom surface, and which further comprises a saddle connecting two peaks.

20. The magazine well extension of claim 9, wherein the second exterior surface extends from the upper contour to the lower contour and the second exterior surface defines a side grip face.

* * * * *